United States Patent [19]

Thore

[11] Patent Number: 4,554,801

[45] Date of Patent: Nov. 26, 1985

[54] PILE FABRIC METHOD AND APPARATUS

[75] Inventor: Thomas J. Thore, Tarboro, N.C.

[73] Assignee: Glenoit Mills, Inc., Tarboro, N.C.

[21] Appl. No.: 407,935

[22] Filed: Aug. 13, 1982

[51] Int. Cl.[4] ..... D04B 9/14

[52] U.S. Cl. ..... 66/9 B; 66/12; 66/42 R

[58] Field of Search ..... 66/9 B, 12, 40, 42 R, 66/194

[56] References Cited

U.S. PATENT DOCUMENTS

| | | | |
|---|---|---|---|
| 1,683,699 | 9/1928 | Rubenstein | 66/42 R X |
| 2,261,805 | 11/1941 | Hiller | 66/42 R |
| 2,379,852 | 7/1945 | Nebel | 66/194 |
| 3,023,596 | 3/1962 | Hill | 66/9 B X |
| 3,413,823 | 12/1968 | Beucus et al. | 66/9 B |
| 3,886,767 | 6/1975 | Dargie | 66/9 B |
| 4,050,267 | 9/1977 | Schaab et al. | 66/9 B |
| 4,245,487 | 1/1981 | Schaab et al. | 66/9 B |
| 4,409,800 | 10/1983 | Gutschmit et al. | 66/9 R |

FOREIGN PATENT DOCUMENTS

| | | | |
|---|---|---|---|
| 1096073 | 12/1954 | France | 66/42 R |
| 225960 | 12/1924 | United Kingdom | 66/42 R |

*Primary Examiner*—Wm. Carter Reynolds

*Attorney, Agent, or Firm*—B. B. Olive

[57] ABSTRACT

A method and apparatus for producing a circular knit, high pile fabric is based on knitting a base fabric with two yarns per course. Long butt needles alternate with short butt needles around the needle circle. First and second yarns are provided at each feed. Sliver is fed to all needles at each of several feeds. At a first feed, long butt needles knit the first yarn in alternate wales with such first yarn being floated in intervening wales whereas at the same first feed short butt needles knit the second yarn in intervening wales with such second yarn being floated in alternate wales. At the next or at the first of the next pair of feeds long butt needles knit the second yarn in alternate wales with such second yarn being floated in intervening wales whereas short butt needles at the same feed knit the first yarn in intervening wales with such first yarn being floated in intervening wales. The sliver fibers are caught at each stitch intersection.

8 Claims, 7 Drawing Figures

PILE FABRIC METHOD AND APPARATUS

DESCRIPTION

1. Technical Field

The invention relates to method and apparatus for making circular knit pile fabric and to circular knit pile fabric constructions.

2. Background Art

Sliver knit high pile fabric, often called "deep pile" fabric, conventionally consists of a jersey knit base fabric from one side of which extend the free ends of tufts of sliver fibers. The tufts are anchored by the stitches of the base fabric.

Deep pile fabrics are typically manufactured on multi-feed circular knitting machines equipped with carding means that take fibers from slivers on other loosely bound fiber assemblies and supply these fibers to the hook portions of the knitting needles. A single body yarn is normally supplied to the hook portions of the knitting needles at each feed and the needles are manipulated to draw the body yarns into interlocked loops to form a jersey knit base fabric into which the pile fibers supplied by the carding means are bound in with the body yarn loops. The end portions of the fibers project from the body yarn loops to form a pile surface on the knitted fabric. Ordinarily, air jets are directed toward the hook portions of the needles so as to dispose the pile fibers on the inside or front face of the circular knit fabric. After the knitting operation, the tubular fabric is slit longitudinally and subjected to suitable finishing treatments such as coating, shearing and the like.

Even though the jersey knit construction for high pile base fabric has shortcomings with regard to both fabric stability and pile fiber retention, it is still widely used. U.S. Pat. Nos. 2,985,001; 3,023,596; 3,226,952; 3,886,767 and 4,050,267 exemplify other methods and fabric constructions used for achieving a high pile fabric utilizing a multi-feed circular knitting machine.

In U.S. Pat. No. 2,014,026 there is taught a run resistant hosiery fabric construction in which each course is knitted with the same two threads. One of the threads is knitted into alternate wales and floated across intervening wales in alternate courses, and knitted into intervening wales and floated across alternate wales in intervening courses. The other thread is knitted into intervening wales and floated across alternate wales in alternate courses and knitted into alternate wales and floated across intervening wales in intervening courses.

With the above prior art background in mind, the present invention seeks to provide a method and apparatus for making an improved high pile fabric in a manner which enables an improved form of the fabric construction taught by U.S. Pat. No. 2,014,026 to be obtained in making the base fabric but with separate sets of two yarns in each course and an overall improved dimensionally stable high pile fabric in which the pile fibers are securely locked into each stitch of such improved base fabric construction.

DISCLOSURE OF INVENTION

The method of the invention and the fabric construction achieved by such method are described by way of example as being made on a modified, 8-feed, high pile fabric, circular knitting machine. In the modified machine, for purposes of reference and description, the needles are divided into long butt needles and short butt needles and are positioned by means of long butt, short butt and shank butt needle control.

The invention fabric construction changes from course to course and from wale to wale. The courses, for reference, are divided into alternate courses and intervening courses and the wales, for reference, are divided into alternate wales and intervening wales. At each pile fiber feed station, all the needles are raised and take tufts of pile fabric from a conventional doffer feeding a conventional supply of roving to the needles. After taking pile fiber on all the needles, the needles are selected as they move past a yarn feed station at which two separate threads are fed to the needles, one thread supply being at a relatively high level and the other thread supply being at a relatively low level. In each course one of the threads is knit in alternate wales and floated in intervening wales and the other thread is knit in intervening wales and floated in alternate wales. The needles selected to form stitches in alternate wales in one course form stitches in intervening wales in the next course. This cycle repeats throughout the formation of the base fabric with the result being to achieve a substantially improved high pile fabric having greater fabric stability and substantially improved pile fiber retention.

BEST MODE FOR CARRYING OUT THE INVENTION

Figure 1:
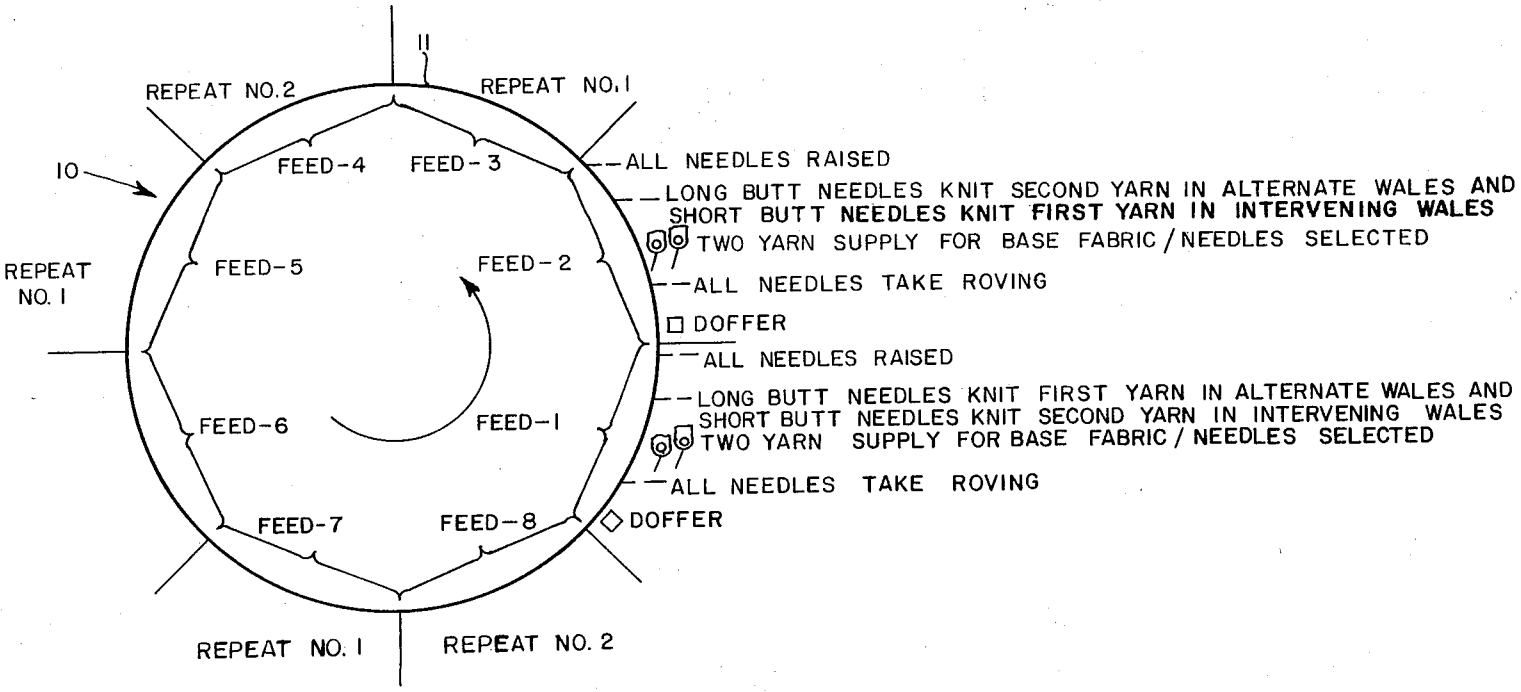
FIG. 1 is a schematic diagram of the knitting circle illustrating the feed and needle selection arrangement and the steps associated with the method of the invention according to a first embodiment.

In FIG. 1, there is shown schematically in top plan the knitting head of a multi-feed sliver high pile fabric circular knitting machine 10 to which the invention has been applied and used as an illustrative embodiment. The machine 10 is provided, for purposes of illustration, with eight sliver and yarn feeding stations spaced uniformly about the circle 11 of needles (not shown). The needles are of the conventional independent latch type, (See FIGS. 4–5), mounted for rotation is the usual rotatable needle cylinder (not shown). The needle cylinder and its complement of needles typically rotate in the counter-clockwise direction indicated by the curved arrow in FIG. 1.

Figure 2:
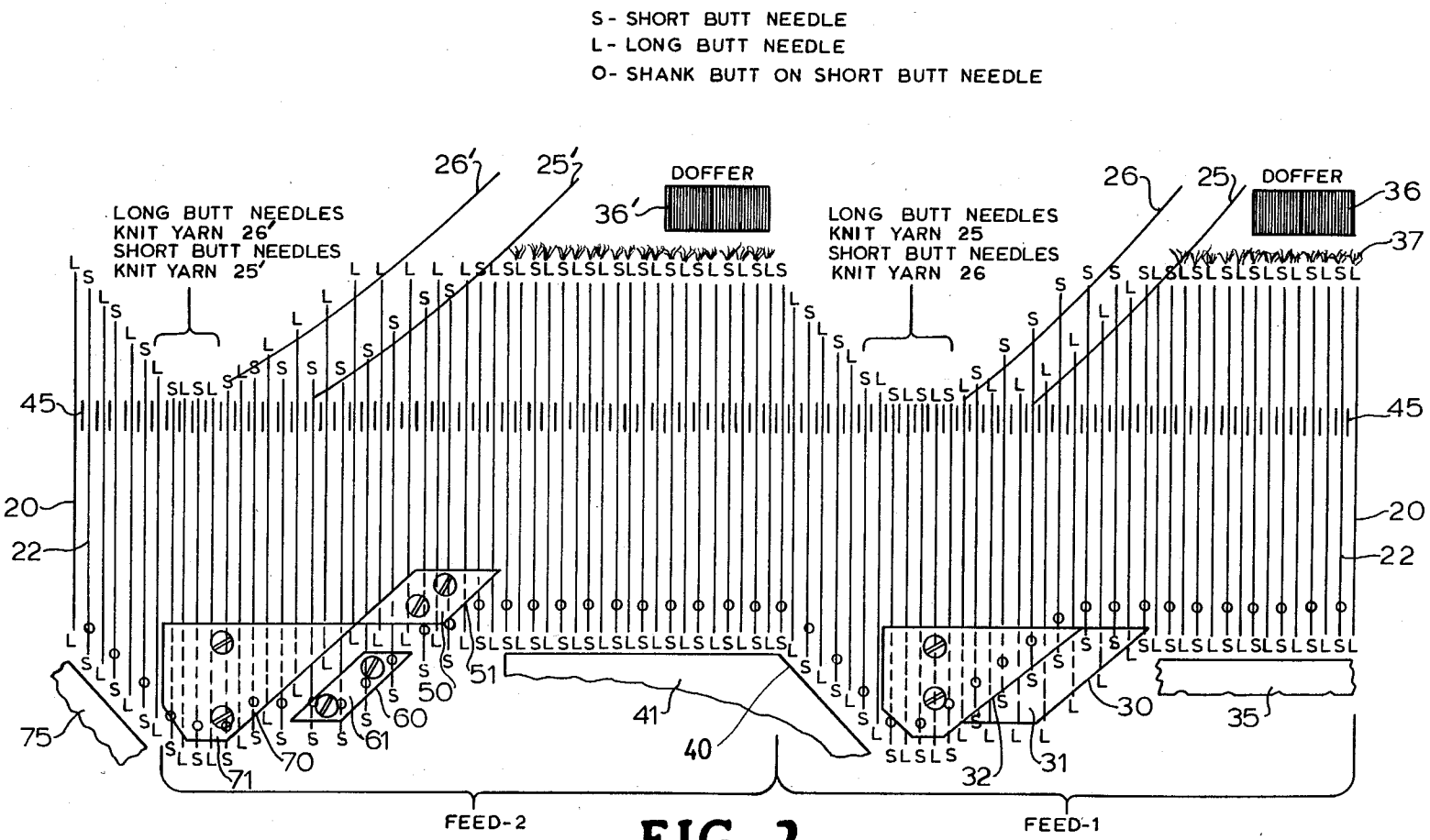
FIG. 2 is a fragmentary schematic view in elevation, looking outwardly from within the needle cylinder, illustrating the knitting cams, yarn feeds and doffers at successive sliver and yarn feeding stations of the machine.

The eight circumferentially spaced sliver and yarn feeding stations have been designated, proceeding in the direction of needle rotation, by the legends feed-1, feed-2, et cetera, through feed-8. Located at each of the feeding stations 1–8 are, respectively, sliver feeding means or devices, frequently referred to as cards and labeled in FIG. 1 as the doffer. Each doffer thus delivers roving to all of the needles which are raised as they pass each successive doffer. The conventional doffer rotates about an axis and includes a fiber engaging periphery with a beginning and an end axially of the doffer in the direction of needle cylinder rotation as generally depicted in FIG. 2. The needles at a given level, later described, pass the doffer from beginning to end and receive fibers therefrom as the doffer rotates.

In the embodiment of the invention illustrated, two separate, vertically and laterally spaced, yarn feeding means are disposed at each of the feeding stations, i.e., feeds 1–8. Thus, two yarn supplies are associated with each of the rovings of sliver fibers fed to the needles of the machine and each course is thus formed of two yarns. That is, feed 1 forms a course with those two yarns fed at the feed 1 station whereas feed 2 forms another course with two separate yarns fed at the feed 2 station. In each case, as illustrated in FIG. 1, each yarn feed is disposed to feed yarn to the needles at a point adjacent to and trailing the fixed location where roving is fed to all the needles.

As further illustrated in FIG. 1 and using feed 1 and feed 2 initially for reference, it will be noted that all needles are raised prior to reaching the doffer or roving supply for feed 1 and all needles take roving as they pass through the doffer associated with feed 1. With continuing reference to FIG. 1, it will be further noted that after the needles take roving all needles pass a yarn feeding station at which two yarns are fed to the needles and the needles are selected by pulling selected needles down such that long butt needles knit one yarn in alternate wales with such yarn being floated in intervening wales while the short butt needles knit the other yarn in intervening wales and with such other yarn being floated in alternate wales. As will be apparent from FIG. 2, the short butt needles at Feed 1 remain at the level at which they pass the first yarn feed until reaching the second yarn feed. After forming the stitches in this manner, all needles are raised preparatory to proceeding to feed 2.

With continuing reference to FIG. 1, it will be noted that the sliver and yarn feeding station of feed 1 is essentially the same as the sliver and yarn feeding station of feed 2. However, if feed 1 is thought of as forming the first or alternate course, the second or intervening course formed by feed 2 from a separate supply of two yarns will be formed such that the long butt needles knit one yarn in the alternate wales and with such yarn in intervening wales whereas the short butt needles knit the other yarn in intervening wales and with such other yarn being floated in alternate wales in the manner illustrated in FIG. 1. As further illustrated in FIG. 1, feeds 3, 5 and 7 repeat the sliver and yarn feeding station arrangement of feed 1 whereas feeds 4, 6 and 8 repeat the sliver and yarn feeding station arrangement of feed 2. Thus, the courses formed by feeds 1, 3, 5 and 7 are similar in construction whereas the courses formed by feeds 2, 4, 6 and 8 are also similar in construction.

Figure 4:
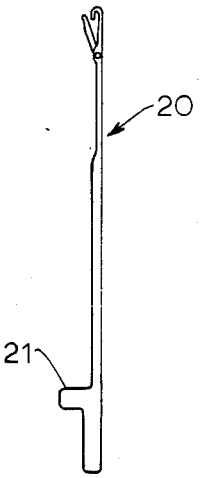
FIG. 4 illustrates the shape of the long butt and FIG. 5 the shape of the short butt needles used in the invention method.
Figure 5:
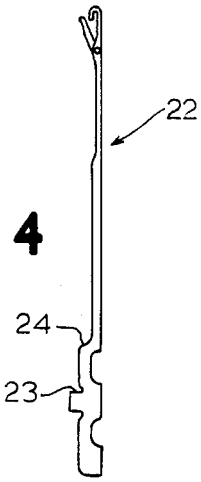

To better illustrate the manner of knitting the fabric, reference is made to FIG. 2 representing a flat development of the needle and cam arrangement as the viewer looks outward from within the needle cylinder. In FIG. 2 the dual yarn feed and cam arrangement for feed 1 are illustrated followed by the dual yarn feed and cam arrangement for feed 2. The long butt needles 20 (labeled "L" in FIG. 2) have long butts 21 (FIG. 4) and the intervening needles 22 (labeled "S" in FIG. 2) have both short butts 23 and a high or shank butt 24 (FIG. 5). The labels "L", "S" and "O" are also used in FIG. 2 to indicate the relative positions of the butts as they ride on the control cams during knitting. The illustrated arrangement, after the needles are guided by conventional cam 35 past doffer 36 to take tufts of pile fiber 37 on all needles, permits the long butt needles 20, with the long butts 21, to take only the first yarn 25 and to be drawn down for knitting by the leading surface 30 of the stitch cam 31 at feed 1. The short butt needles 22, with the short butts 23, take the second yarn 26 only and they are drawn down by the trailing surface 32 of the stitch cam. As will be apparent from FIG. 2, the short butt needles 22 remain at the same level as when passing first yarn 25 at least until the first yarn received by the long butt needles 20 is drawn below the latch of the short butt needles. Since the trailing surface 32 is lower than the leading surface 30, the trailing stitch cam surface 32 lowers both sets of needles 20, 22 to cast-off level, to cast off the stitches on the needles and form a fresh course of fabric. Thereafter, all needles rise along the upward sloping surface 40 of a conventional cam 41.

In FIG. 2, it is important to observe at feed station 1 that the long butt needles 20, with the long butts 21, are drawn down by the cam surface 30 to a limited level whereby the tops of their hooks are disposed in the horizontal plane running slightly above the tops of the ledges of the sinkers 45. As a result, the first yarn 25 is caused to lay along the ledges of a few sinkers 45 in a horizontal line, with the tops of the hooks of the long butt needles 20 disposed slightly above the horizontal plane of the sinker ledges. This ensures that the latches of the long butt needles 20 are closed, so that the second yarn 26 does not find its way into the hooks of the long butt needles 20. This arrangement also ensures that the second yarn 26 is knit only by the short butt needles 22 which are caused to descend by the cam surface 32. As in conventional knitting, the sinkers are inserted when the needles are being raised and during taking of the pile fiber. Also as with conventional knitting, the sinkers are withdrawn prior to lowering those needles which take yarn. Since every other needle is initially drawn down after the pile fiber has been taken, as illustrated in FIG. 2, rather than all needles being drawn down together as in conventional jersey knitting the sinker cam action is adjusted according to the invention requirements as will be apparent to those skilled in the knitting art.

After all of the needles knit in the manner just explained, they proceed to the next feeding station, i.e., feed station 2, where, after taking pile fiber from doffer 36′, their actions are reversed, i.e., at the next knitting station, feed 2, the long butt needles 20 knit the second yarn 26′ in alternate wales and the short butt needles 22 knit the other second yarn 25′ in intervening wales. Before making further reference to FIG. 2, it will again be noted as seen in FIG. 4 that the long butt needles 20 l use only the long butts 21 for needle control. The short butt needles 22 will be noted, however, in FIG. 5 as having both short butts 23 and an elevated high or shank butt 24 for needle control.

Referring once again to FIG. 2, it will be noted that as the needles pass through feed station 2, the high butts 24, positionally represented as "O" in FIG. 2, on the short butt needles 22 first engage the cam 50 by riding down on cam surface 51 following which the short butts 23 of the short butt needles 22 engage surface 60 of cam 61 while the long butt needles engage cam surface 70 of cam 71 in the manner best illustrated in FIG. 2. After all the needles knit, in the manner illustrated in FIG. 2, they ride on conventional cam 75 and proceed to the next feeding station, i.e., feeding station 3, where the needle actions again revert to the actions which took place at feed station 1.

Figure 3:
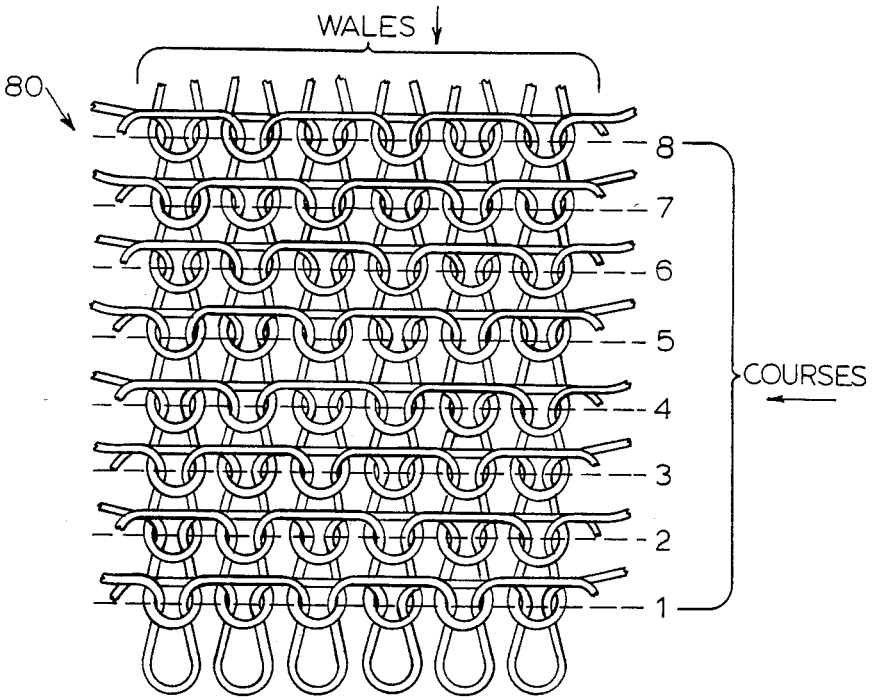
FIG. 3 illustrates the back face of the fabric achieved by the invention method with the high pile fiber, not shown, being secured on the opposite front side of the fabric.
Figure 6:
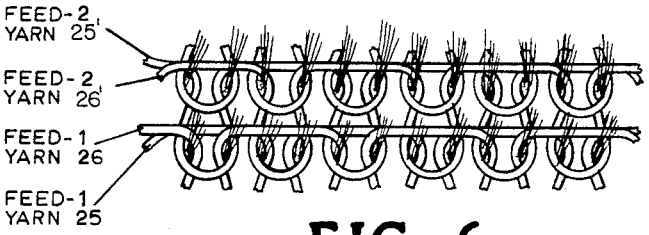
FIG. 6 illustrates a portion of the fabric of FIG. 3 showing how the tufts of fibers are trapped in the stitch-float intersections.

Certain distinguishing characteristics of the improved fabric 80 as seen in FIGS. 3 and 6 may be observed. In this regard, it will be noted that each course is formed of a set of two yarns and every course is formed from a different set of two yarns. For the eight feed embodiment, illustrated by way of example, the sets of yarns equal the number of feeds and repeat every eight courses. In each course, one of the yarns is knit in alternate wales and floated across intervening wales whereas the other yarn is knit in intervening wales and floated across alternate wales. The floats appear at the back of the fabric and one of the yarns in each course is closer to the back face of the fabric than is the other yarn. In a walewise direction in alternate courses and alternate wales, the floats formed by one yarn are behind the stitches formed by the other yarn and in intervening courses and intervening wales the floats formed by one yarn are on the back of the fabric. Finally, it will be noted that tufts of pile fabric are caught in each stitch-float intersection formed in the base fabric as schematically illustrated in FIG. 6.

In summary, according to the improved, high pile, sliver knitting method of the invention according to the first embodiment, each base fabric course is formed with two yarns and the manner of knitting the two yarns alternates from feed to feed. Thus, to again state what has previously been mentioned and as best illustrated in FIG. 1, at feed-1 after all needles have taken fiber, the needles are selectively pulled down while passing through feed-1 such that the long butt needles knit one base fabric yarn in alternate wales and the short butt needles knit the other base fabric yarn in intervening wales with the roving fiber being caught by all of the respective stitches and floats formed in both the alternate and intervening wales as seen in FIG. 6. After all the needles are raised at feed 1 and additional roving fiber is taken on all needles at feed 2, the needles are again selectively pulled down while being fed two separate yarns for the course being formed. However, at feed-2 the needle selected is such that long butt needles knit one yarn in alternate wales of the base fabric and the short butt needles knit the other yarn in intervening wales of the base fabric. Again, as with the action at feed-1, the roving fiber is firmly caught in each respective float and stitch formations in both the alternate and intervening wales as illustrated in FIG. 6. The ultimate improvement made by this invention is a superior sliver knit high pile fabric, which is more stable dimensionally and, even more important, better anchors the tufts of sliver fibers. Here it should be noted that a plain knit or jersey fabric does not anchor the tufts of sliver fibers effectively, and hence excessive fiber losses occur. To limit such fiber loss, it is conventional practice at the present time to back coat sliver knit, high pile fabrics with some type of adhesive compound which, when dried, locks the fibers in the base fabric. The new base fabric of this invention however will normally not require back coating, because it reduces fiber loss due to its superior stitch construction, better locking the tufts of fibers in the fabric.

Figure 7:
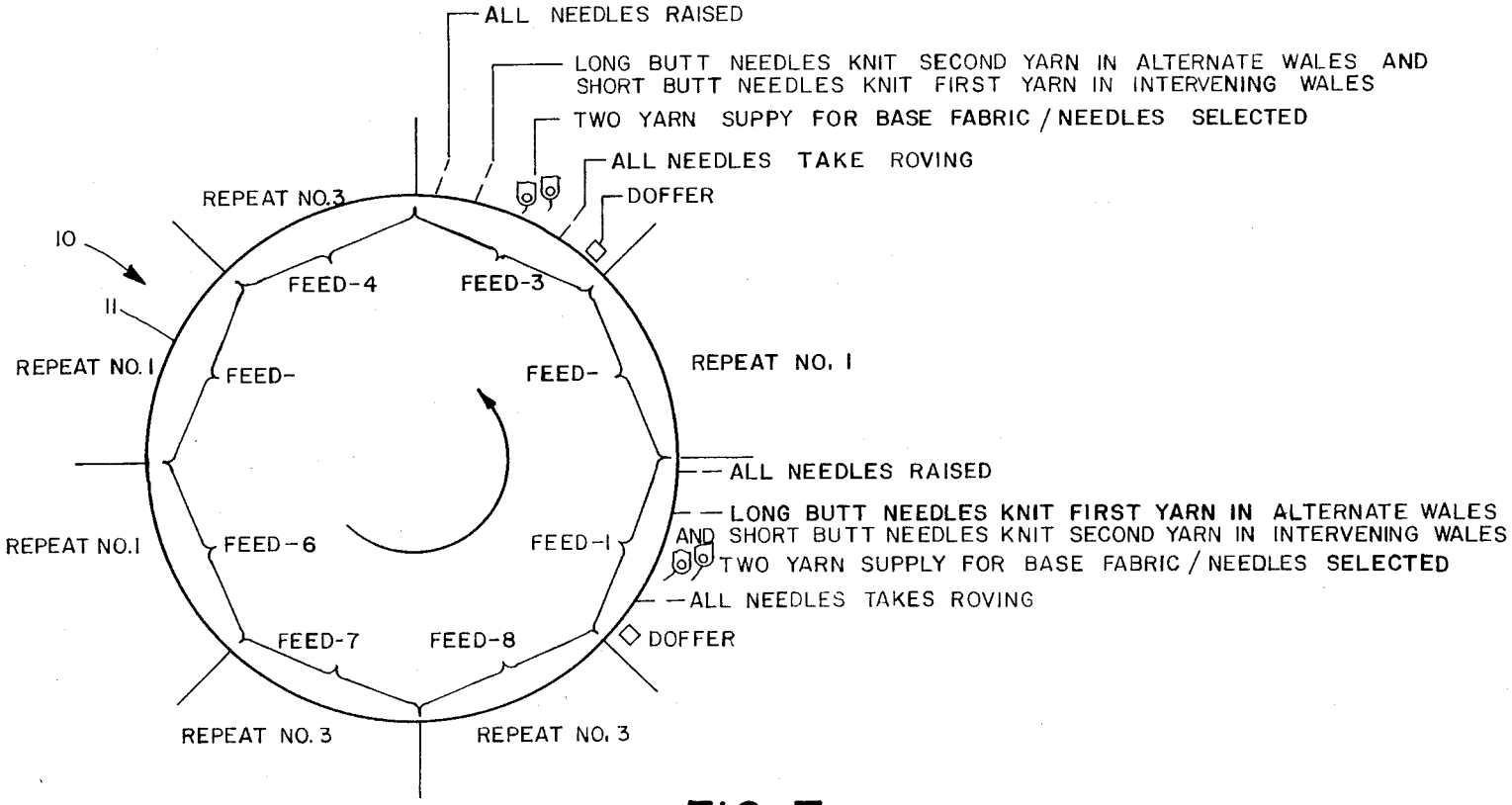
FIG. 7 is a schematic diagram of the knitting circle illustrating the feed and needle selection arrangement and the steps associated with the method of the invention according to a second embodiment.

In an alternative embodiment schematically illustrated in FIG. 7, the yarn feeds are effectively arranged by pairs. Thus, the same yarn, e.g., the first yarn 25, knit in alternate wales at feed-1 by the long butt needles 20 is also knit by the long butt needles 20 in alternate wales at feed-2. Further, the same yarn which is knit by the short butt needles 22 in intervening wales, e.g., the second yarn 26, at feed-1 is also knit by the short butt needles 22 in intervening wales at feed-2. The course construction produced at feed-1 is thus the same as the course construction produced at feed-2. In a similar manner, the course construction produced at feed-3 is repeated at feed-4, etc. The sinker action in the second embodiment corresponds to that previously explained with respect to the first embodiment. In this second embodiment, as with the first embodiment, it can be seen that a substantially improved base fabric and overall improved pile fabric is achieved.

Among the several advantages achieved is the fact that it now becomes possible to make substantially lighter weight pile fabric with smaller threads and thus achieve higher tear strength with lighter weight fabric. Further, the lightweight fabric of the invention exhibits a noticeably denser characteristic. When the fiber and base fabric threads are both selected to be of a heat settable type, it has also been found that when the improved fabric of the invention is heat set, the end result is to achieve a pile fabric in which the pile fiber is more securely locked in than has heretofore been achieved in heavier and less dense prior pile fabrics which have been heat set.

What is claimed is:

1. The method of knitting sliver high pile fabric on a circular knitting machine having a plurality of feed stations, a circle of independent selectively positionable needles and sinkers, and sliver and yarn feeds at each feed station, said circle of needles being made up of long butt needles alternating with short butt needles, comprising the steps of:

(a) providing at each feed station a sliver feeding device adapted to deliver an individual roving of sliver fibers to the needle circle to be taken by all the needles rotating past such device;

(b) providing a first and second yarn feed at each feed station, each yarn feed being adapted to feed a separate yarn to the needles after having said fibers taken thereon and being spaced from the other yarn feed; and (c) positioning said needles at each feed station such that all needles take said roving fibers and thereafter in the direction of rotation of the needles, said needles are selected and said sinkers positioned such that in a repetitive knitting cycle:

(i) at each of selected feed stations long butt needles knit the first yarn in alternate wales with such first yarn being floated in intervening wales whereas the short butt needles knit the second yarn in intervening wales with such second yarn being floated in alternate wales;

(ii) at each of other selected feed stations long butt needles knit the second yarn in the said alternate wales with such second yarn being floated in the said intervening wales and short butt needles knit the first yarn in the said intervening wales with such first yarn being floated in said alternate wales; and (iii) said sliver fibers are caught in each float stitch intersection in said fabric.

2. The method of claim 1 wherein said selected feed stations alternate with said other selected feed stations.

3. The method of claim 1 wherein pairs of said selected feed stations alternate with pairs of said other selected feed stations.

4. In a sliver high pile fabric knitting machine having a rotatable circle of independent selectively positionable needles and sinkers and a plurality of sliver and yarn feeding stations spaced circumferentially around the needles circle, said circle of needles being made up of long butt needles alternating with short butt needles, in combination:

(a) a sliver feeding device at each feed station adapted to deliver an individual roving of sliver fibers to the needle circle to be taken by all the needles rotating past such device;

(b) first and second yarn feeds at each feed station, each yarn feed being adapted to feed a separate yarn to the needles after said fibers have been taken thereon and being spaced from the other yarn feed; and (c) needle cams disposed adjacent said sliver feeding device and yarn feeds at each said feed station for selecting and positioning the needles to receive sliver fibers and both said yarns and form said fibers and yarns into a course of pile fiber retaining fabric, said cams being formed for operation in conjunction with the sinkers associated with said machine such that:

(i) at each of selected feed stations long butt needles knit the first yarn in alternate wales with such first yarn being floated in intervening wales whereas the short butt needles knit the second yarn in intervening wales with such second yarn being floated in alternate wales;

(ii) at each of other selected feed stations long butt needles knit the second yarn in said alternate wales with such second yarn being floated in said intervening wales and short butt needles knit the first yarn in said intervening wales with such first yarn being floated in said alternate wales; and (iii) said sliver fibers are trapped in each stitchfloat intersection produced by said yarns.

5. In a knitting machine as claimed in claim 4 wherein said selected feed stations alternate with said other selected feed stations.

6. In a knitting machine as claimed in claim 4 wherein pairs of said selected feed stations alternate with pairs of said other selected feed stations.

7. In a sliver high pile fabric knitting machine having a rotatable circle of independent selectively positionable needles and sinkers and a plurality of sliver and yarn feeding stations spaced circumferentially around the needle circle, said circle of needles being made up of long butt needles alternating with short butt needles, in combination:

(a) a sliver feeding device at each feed station adapted to deliver an individual roving of sliver fibers to the needle circle to be taken by all the needles rotating past such device;

(b) first and second yarn feeds at each feed station, each said first yarn feed being adapted to feed a first yarn to the needles after said fibers have been taken thereon and being spaced from the said second yarn feed adapted to feed a second yarn to the needles after said fibers have been taken thereon; and (c) needle cams disposed adjacent said sliver feeding device and yarn feeds at each said feed station for positioning and selecting the needles to receive sliver fibers and both said yarns and form said fibers and yarns into a course of pile fiber retaining fabric, said cams being formed for operation in conjunction with the sinkers associated with said machine such that:

(i) at a first feed station long butt needles are selected to knit the first yarn in alternate wales with such first yarn being floated in intervening wales whereas the short butt needles are selected to knit the second yarn in said intervening wales with such second yarn being floated in said alternate wales;

(ii) at a second feed station long butt needles are selected to knit the second yarn in said alternate wales with such second yarn being floated in said intervening wales and short butt needles are selected to knit the first yarn in said intervening wales with such first yarn being floated in said alternate wales;

(iii) said sliver fibers are trapped in each stitchfloat intersection produced by said yarns;

(iv) said needles at both said stations are selected by the respective cams operative thereon by being selectively pulled down while passing through said stations; and (v) said knitting operations at said first and second feed stations repeat at each successive pair of stations.

8. A circular knitting machine for knitting high pile fabric comprising: a rotatable cylinder with alternate and intervening needles in slots about the periphery thereof; each said alternate needle including a latch and a butt means of a first type; each said intervening needle including a latch and a butt means of a second type; a knitting station with a doffer, a first yarn feed, and a second yarn feed; said doffer being rotatable about an axis and including a fiber engaging periphery with a beginning and an end axially of the doffer in the direction of needle cylinder rotation; a first cam means successively engaging said butt means of said first and second types as said needle cylinder rotates to raise each needle to a receiving level; each of said alternate and intervening needles passing at said level from said beginning to said end of said doffer periphery and receiving fibers therefrom as said doffer rotates; each of said alternate and intervening needles remaining at said level during passage from said doffer to said first yarn feed; a second cam means successively engaging said butt means of a first type to lower said alternate needles during receipt by said alternate needles of a first yarn from said first feed; each said intervening needle remaining at said level during passage by said first yarn feed at least until the first yarn being received by said alternate needles is drawn below the latch of said intervening needle; and a third cam means successively engaging said butt means of a second type to lower said intervening needles during receipt by said intervening needles of a second yarn from said second feed; all of said needles being lowered to knockover level at said station after receipt of said yarns; whereby said alternate needles form knit stitches of said first yarn with incorporated fibers while forming floats of said second yarn and said intervening needles form knit stitches of said second yarn with incorporated fibers while forming floats of said first yarn.

* * * * *